US009982857B2

(12) United States Patent
Dalal

(10) Patent No.: US 9,982,857 B2
(45) Date of Patent: May 29, 2018

(54) VEHICLE LIGHTS INCLUDING MOISTURE MANAGEMENT APPARATUSES

(71) Applicant: Toyota Motor Engineering & Manufacturing North America, Inc., Erlanger, KY (US)

(72) Inventor: Sunil Dalal, Canton, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 289 days.

(21) Appl. No.: 14/918,181

(22) Filed: Oct. 20, 2015

(65) Prior Publication Data

US 2017/0108192 A1 Apr. 20, 2017

(51) Int. Cl.
*F21V 23/02* (2006.01)

(52) U.S. Cl.
CPC ..... *F21S 45/33* (2018.01)

(58) Field of Classification Search
CPC ..... F21S 48/355; F21S 48/34; F21S 48/332
See application file for complete search history.

(56) References Cited

U.S. PATENT DOCUMENTS

| | | | | |
|---|---|---|---|---|
| 5,251,111 | A | 10/1993 | Nagengast et al. | |
| 5,775,794 | A | 7/1998 | Schmitt | |
| 2007/0091632 | A1* | 4/2007 | Glovatsky | B60Q 1/0052 362/547 |
| 2011/0310631 | A1* | 12/2011 | Davis | F21S 48/115 362/547 |
| 2014/0140085 | A1* | 5/2014 | Matsumoto | F21S 48/1159 362/516 |
| 2015/0070927 | A1* | 3/2015 | Kurahashi | F21S 48/335 362/546 |

FOREIGN PATENT DOCUMENTS

| | | | |
|---|---|---|---|
| DE | 102011084114 | A1 | 4/2013 |
| EP | 2020569 | A2 | 2/2009 |
| JP | 6-314504 | A | 11/1994 |
| WO | 00/047932 | A1 | 8/2000 |
| WO | 2015/024839 | A1 | 2/2015 |

* cited by examiner

*Primary Examiner* — Anabel Ton
(74) *Attorney, Agent, or Firm* — Dinsmore & Shohl LLP

(57) ABSTRACT

A light with improved moisture control for a vehicle. The light has a housing and a lens, the housing and the lens forming a light interior. The light also includes a lamp that is at least partially enclosed within the light interior. A vent duct is included and extends through the housing from the light interior to an exterior of the light. An anti-humidity fan is present within the vent duct and is operable to move moisture from the light interior to the exterior of the light and thereby prevent fogging of the light lens.

17 Claims, 2 Drawing Sheets

VEHICLE LIGHTS INCLUDING MOISTURE MANAGEMENT APPARATUSES

TECHNICAL FIELD

The present application is directed to vehicle light assemblies, and in particular to a vehicle light assembly that uses an electric ducted fan within a light housing for moisture management and elimination of fogging of the vehicle light assembly.

BACKGROUND

Vehicles include vehicle light assemblies such as headlights, rear lights, turn signal lights, backup lights. Such vehicle light assemblies can include a vehicle light housing, a lens and a lamp (incandescent bulb or LED) enclosed within an interior formed by the vehicle light housing and the lens. In addition, such vehicle light assemblies can be used during operation of the motor vehicle during moments of reduced visibility such as nighttime hours, when it is raining, foggy, etc.

Moisture can leak into the interior of the vehicle light housing. In some instances, the escape of moisture from the interior of the vehicle light housing may not be rapid enough to inhibit condensation on an inner surface of the lens. Such a phenomenon is typically known as "fogging", which, in turn, can reduce the illumination capability of the vehicle light assembly, providing an unaesthetically pleasing appearance to the light lens. Therefore, vehicle light assemblies having improved moisture management apparatuses would be desirable.

SUMMARY

In one embodiment a vehicle light assembly may include a vehicle light housing and a lens. The vehicle light housing and the lens form an enclosure or interior, i.e. a light interior of the vehicle light assembly. The light also includes a lamp that is at least partially enclosed within the light interior such that illumination is provided as is known to those skilled in the art. A vent duct that extends through the housing from the light interior to an exterior of the light (light exterior) can also be included. An anti-humidity fan is present within the vent duct and is operable to move moisture from the light interior to the exterior of the light and thereby prevent fogging of the light lens. In some instances, the light is a headlight and the housing is a headlight housing, the headlight housing and the lens forming or enclosing a headlight interior. In addition, the vent duct has a first diameter along a first portion thereof and a second diameter along a second portion. The first diameter is less than the second diameter and the anti-humidity fan is located within the second portion of the vent duct. The first portion can have a diameter between 4-8 millimeters (mm) and the second portion can have a diameter between 12-20 mm.

The light has a power supply and a switch in electrical communication with the anti-humidity fan. The power supply is operable to energize the anti-humidity fan and the switch is operable to electrically connect and de-connect the anti-humidity fan from the power supply.

In some instances, a humidity sensor located within the light interior and in electrical communication with the switch can be part of the light. The humidity sensor is operable to detect a humidity level within the light interior and provide a high-humidity signal when the humidity level is above a predefined threshold value or level. In other instances, a timer can be included and be in electrical communication with the switch, the timer operable to detect an elapsed time and provide a time-elapsed signal when a predetermined amount of time has elapsed after a predefined starting point. For example, the predefined starting point can be the starting of an engine and/or a motor of the vehicle such that when operation of the vehicle.

These and additional features provided by the examples, aspects, etc. described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative examples, aspects, etc. can be understood when read in conjunction with the following drawings, where like structure is indicated with like reference numerals and in which:

DETAILED DESCRIPTION

A vehicle light assembly such as a headlight, taillight, etc. for a vehicle is described herein. The vehicle light assembly includes a vehicle light housing and a moisture management apparatus within an interior of the vehicle light housing can reduce, prevent or otherwise inhibit fogging, which is condensation of moisture on an interior surface of a lens of the vehicle light assembly.

The vehicle light assembly has the vehicle light housing and a lens which together form a light interior and a lamp that is enclosed at least partially within the light interior. The vehicle light assembly includes a moisture management apparatus that includes vent duct that extends through the vehicle light housing from the light interior to an exterior of the vehicle light housing (light exterior) and providing fluid communication between the interior and exterior of the vehicle light housing. An anti-humidity fan (e.g., an electric anti-humidity fan) is located within the vent duct and during operation can remove moisture from the light interior and thus inhibits fogging of the lens.

The anti-humidity fan can be energized based on a high-humidity signal provided by a humidity sensor that is located within the light interior. In the alternative or in addition, the anti-humidity fan can be energized based on a time-elapsed signal provided by a timer, which detects when a predetermined amount of time has elapsed after a predefined starting point. In this manner, moisture control or management within the vehicle light housing can be improved and fogging of the light lens can be inhibited.

Figure 1:
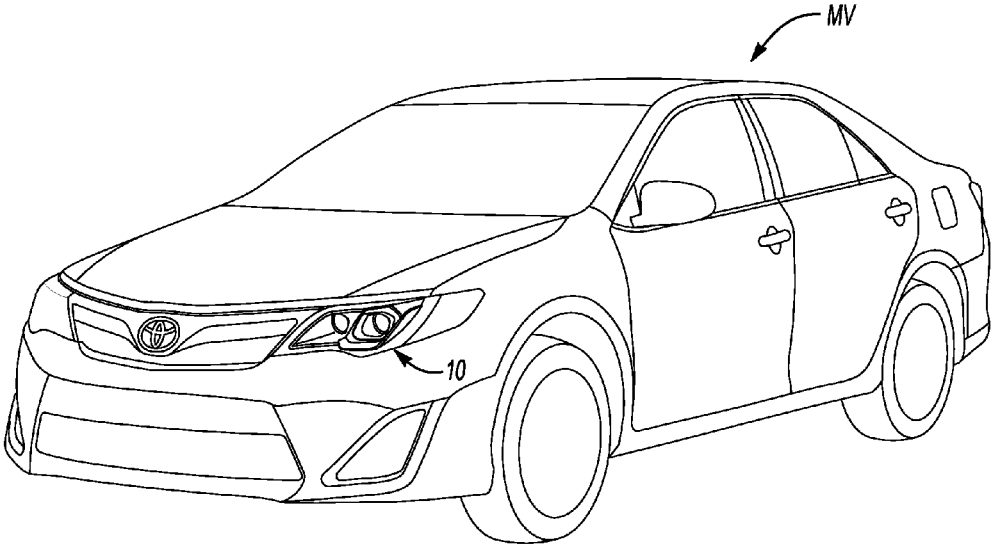
FIG. 1 is a schematic, perspective illustration of a motor vehicle with a vehicle light assembly according to one or more embodiments shown and described herein.

Referring to FIG. 1, a motor vehicle MV with a vehicle light assembly 10 is shown. The light 10 can be a headlight, however this is not required. For example and for illustrative purposes only, the vehicle light assembly 10 can be a taillight, a fog light, a running light, a turn signal light, a backup light, etc.

Figure 2:
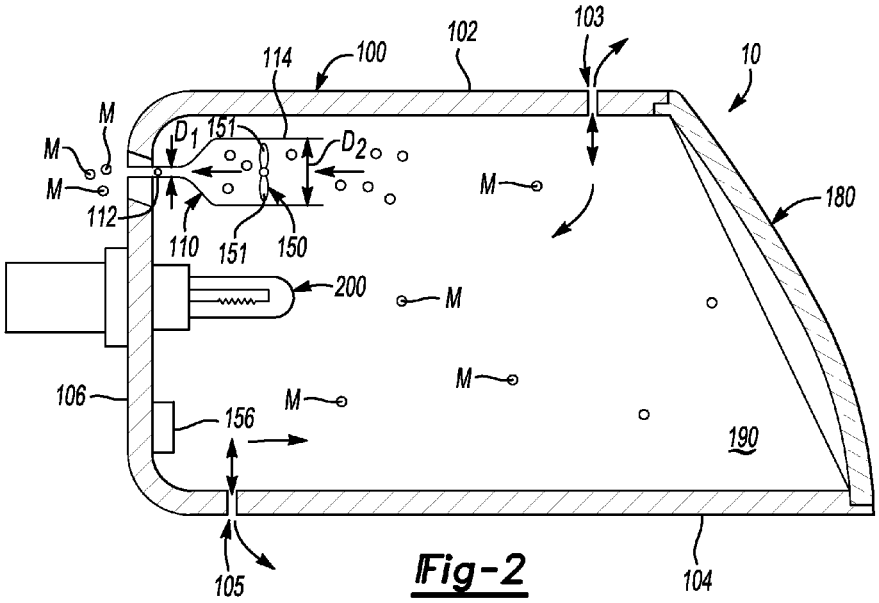
FIG. 2 is a schematic, side cross-sectional view of the vehicle light assembly of FIG. 1 according to one or more embodiments shown and described herein.

FIG. 2 provides a side cross-sectional view of the vehicle light assembly 10, the vehicle light assembly 10 includes a vehicle light housing 100 and a lens 180. The lens 180 can be used to collect and enhance the illumination provided by a lamp 200. In addition, the vehicle light housing 100 and the lens 180 together provide or form a light interior 190. At least partially enclosed within the light interior 190 is the lamp 200 that upon being energized (e.g., automatically and/or manually) provides illumination, which passes through the lens 180 and passes outside the light interior 190.

The vehicle light housing 100 can include a top wall 102, a bottom wall 104, a rear wall 106, and side walls (only side wall 107 is shown). One or more vents can be present within the housing walls, e.g. a vent 103 within the top wall 102 and/or a vent 105 within the bottom wall 104. It is appreciated that the vent 103 and/or vent 105 afford for venting of the vehicle light housing 100, i.e. allows for the removal of moisture from the vehicle light housing 100. However, such vents to prevent fogging in all circumstances and thus the need for an improved venting system. As shown in the figure, the lamp 200 can extend through the back wall 106, for example, to provide an electrical connector 109 for connection to a power source (e.g., a vehicle battery).

The light 10 also has a vent duct 110 that extends through the back wall 106 and thus provides fluid communication between the light interior 190 and an exterior of the vehicle light assembly 10. While the vent duct 110 is illustrated as passing through an opening 111 in the back wall 106, the vent duct 110 can extend through any portion of the housing 100, for example through the top wall 102 or bottom wall 104. The vent duct 110 is illustrated as having a first portion 112 with a diameter $D_1$ and a second portion 114 with a diameter $D_2$. As illustrated in the figure, the diameter $D_1$ of the first portion 112 is less than the diameter $D_2$ of the second portion 114. In some instances, the diameter $D_1$ is between 4-8 millimeters (mm) and the diameter $D_2$ of the second portion is between 12-20 mm.

Located within the second portion 114 of the vent duct 110 is an anti-humidity fan 150 with one or more fan blades 151. While an axial-type fan is illustrated other suitable fan types can be used, such as centrifugal and cross-flow. Location of the anti-humidity fan 150 affords for moisture molecules M to be pulled from the light interior 190, pushed or blown out through the vent duct 110 and expelled to the light exterior. It is appreciated that the diameter $D_2$ accommodates the size of the anti-humidity 150. However, the larger diameter $D_2$ is not required if and when the anti-humidity 150 has a size small enough to fit within the first portion 112 with the diameter $D_1$.

Figure 3:
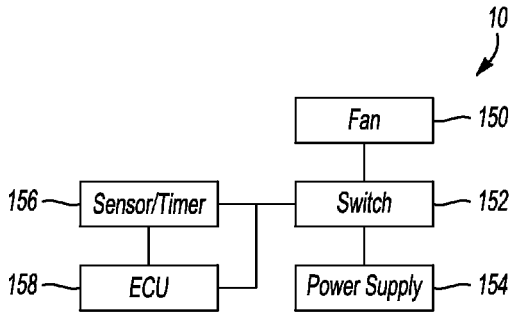
FIG. 3 is a schematic illustration of a fan, switch, power supply, and sensor/timer for use with the vehicle light assembly of FIG. 1 according to one or more embodiments shown and described herein.

The anti-humidity fan 150 can have one or more electric wires or leads (not shown) in electrical communication with a power source, such as a car battery or a power source separate from the car battery. For example, FIG. 3 shows a schematic illustration of the anti-humidity fan 150 in electrical communication with a switch 152, a power supply 154, and a sensor and/or timer 156. The power supply 154 can energize the anti-humidity fan 150 and the switch 152 can electrically connect or de-connect the anti-humidity fan 150 to or from the power supply 154. In some embodiments, the sensor/timer 156 can be in electrical communication with the switch 152 and/or an electronic control unit (ECU) 158 which is in electronic communication with the switch 152. In this manner, the switch 152 can activate or deactivate the fan 150 as a function of a predefined criterion as illustratively discussed below.

The sensor/timer 156 can be a humidity sensor located within the light interior 190 as illustrated in FIG. 2. The humidity sensor 156 can be operable to detect a humidity level within the headlight interior 190 and provide a high-humidity signal to the switch and/or the ECU 158 when the humidity level within the light interior 190 is above a predefined threshold value or level. As such, when the humidity level within the vehicle light assembly 10 reaches a predefined value or level, the humidity sensor 156 can provide a signal indicative of humidity level to the ECU 158, which can activate the anti-humidity fan 150 and thus remove moisture M from the light interior 190. The removal of the moisture M from the light interior 190 can reduce the humidity therewithin such that fogging of the light lens 180 does not occur or is otherwise reduced.

In another example, the sensor/timer 156 can be a timer that is operable to detect an elapsed time and provide a time-elapsed signal to the switch 152 and/or ECU 158 when a predetermined amount of time has elapsed after a predefined starting point. The predefined starting point can be starting of an engine or motor of the vehicle 10, a given and predetermined amount of time after the engine or motor of the vehicle has started, a predefined or predetermined amount of time after a rain or moisture detector has detected that the vehicle MV is being rained on, etc. It is appreciated that an "engine" refers to an internal combustion engine and a "motor" refers to an electric motor, e.g. in a hybrid or all electric vehicle. The time-elapsed signal can also be related to a predetermined amount of time that has elapsed since the anti-humidity fan 150 has been activated. Stated differently, the timer 156 can ensure that the anti-humidity fan 150 is deactivated after it has been in operation for a set amount of time.

Figure 4:
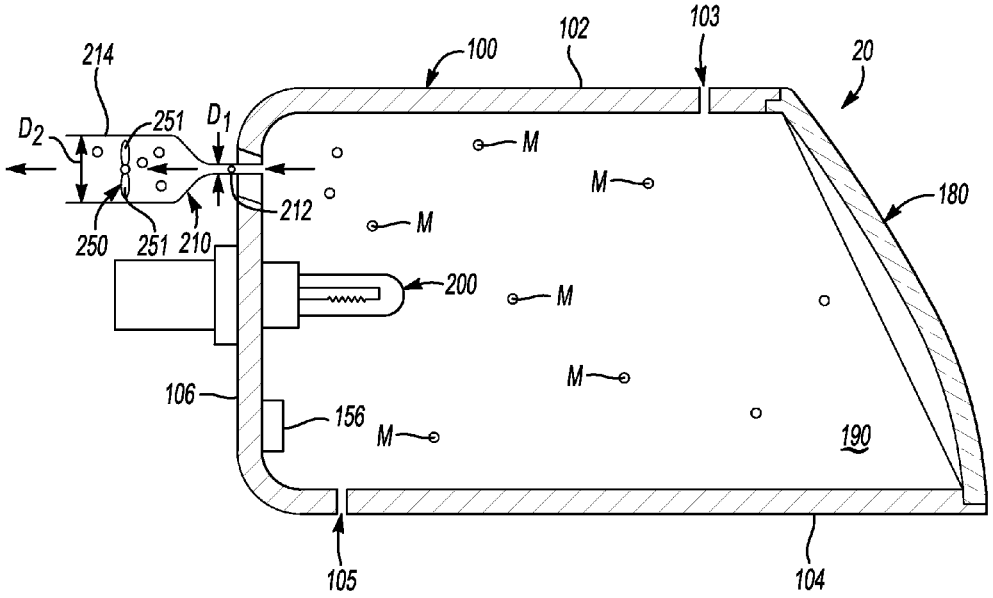
FIG. 4 is a schematic, side cross-sectional view of a vehicle light assembly according to one or more embodiments shown and described herein.

Turning now to FIG. 4 a schematic illustration of a vehicle light assembly according to another aspect is shown. In particular, the vehicle light assembly 20 is similar to the light shown in FIG. 2, however a vent duct 210 and anti-humidity fan 250 are located outside of the light interior 190. It is appreciate that the vent duct 210 with a first portion 212 and second portion 214, and the anti-humidity fan 250 with fan blades 251 as illustrated in FIG. 4 also afford removing moisture molecules M from the light interior 190, reducing the humidity in the light interior 190 and thereby preventing fogging.

The above-described vehicle light assemblies for a vehicle provide an anti-humidity fan within a vent duct which reduces humidity within a light housing interior. As such, fogging of the light lens does not occur.

While particular aspects, examples, etc. have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims, and all equivalents thereof, cover all such changes and modifications that are within the scope of the claimed subject matter.

What is claimed is:

1. A vehicle light assembly for a vehicle comprising:

a vehicle light housing and a lens, said vehicle light housing and said lens together forming a light interior; and a lamp enclosed within said light interior;

a moisture management apparatus comprising:

a vent duct extending from an opening in said housing from said light interior to an exterior of the vehicle light housing; and an anti-humidity fan within said vent duct, said anti-humidity fan operable to move moisture from said light interior to said exterior and prevent fogging of said lens.

2. The vehicle light assembly of claim 1, wherein said vehicle light housing is part of a headlight.

3. The vehicle light assembly of claim 1, wherein said vent duct has a first diameter along a first portion and a second diameter along a second portion, said first diameter being less than said second diameter.

4. The vehicle light assembly of claim 3, wherein said anti-humidity fan is located within said second portion of said vent duct.

5. The vehicle light assembly of claim 4, wherein said first portion has a diameter between 4.0-8.0 mm and said second portion has a diameter between 12.0-20.0 mm.

6. The vehicle light assembly of claim 4, further comprising a power supply and a switch in electrical communication with said anti-humidity fan, said power supply operable to energize said anti-humidity fan and said switch operable to activate and deactivate said anti-humidity fan.

7. The vehicle light assembly of claim 6, further comprising a humidity sensor located within said light interior and in electrical communication with said switch, said humidity sensor operable to detect a humidity level within said light interior and provide a high-humidity signal when said humidity level within said light interior is above a predefine threshold value.

8. The vehicle light assembly of claim 6, further comprising a timer in electrical communication with said switch, said timer operable to detect an elapsed time and provide a time-elapsed signal when a predetermined amount of time has elapsed after a predefined starting point.

9. The vehicle light assembly of claim 8, wherein said predefined starting point is starting of at least one of an engine and a motor of said vehicle.

10. A vehicle having a light, the vehicle comprising:

a headlight housing and lens, said headlight housing and lens forming a headlight interior;

a lamp enclosed within said headlight housing and lens;

a vent duct extending through said headlight housing from said headlight interior to an exterior of the light, said vent duct having a first portion with a first diameter and a second portion with a second diameter, said second diameter greater than said first diameter; and an anti-humidity fan within said vent duct, said anti-humidity fan operable to move moisture from said headlight interior to said exterior of the light and condensation of said moisture within said headlight interior on said lens.

11. The vehicle of claim 10, wherein said anti-humidity fan is located within said second portion of said vent duct.

12. The vehicle of claim 11, wherein said first portion has a diameter between 4.0-8.0 mm and said second portion has a diameter between 12.0-20.0 mm.

13. The vehicle of claim 11, wherein said anti-humidity fan pulls moisture from within said headlight interior, blows said moisture through said vent duct and expels said moisture from said headlight interior.

14. The vehicle of claim 13, wherein said headlight housing has at least one vent aperture in addition to said vent duct.

15. The vehicle of claim 14, further comprising a humidity sensor located within said headlight interior and in electrical communication with said switch, said switch operable to activate said electrical fan when said humidity sensor detects a humidity level within said headlight interior above a predefine threshold value.

16. The vehicle of claim 14, further comprising a timer in electrical communication with said switch, said switch operable to activate said electrical fan when said timer detects that a predetermined amount of time has elapsed after a predefined starting point.

17. The vehicle of claim 16, wherein said predefined starting point is starting of at least one of an engine and a motor of the vehicle.

* * * * *